US008895102B2

(12) United States Patent
Furukawa

(10) Patent No.: US 8,895,102 B2
(45) Date of Patent: Nov. 25, 2014

(54) METHOD OF TREATING SURFACE OF MOLD

(75) Inventor: Yuichi Furukawa, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 502 days.

(21) Appl. No.: 12/914,093

(22) Filed: Oct. 28, 2010

(65) Prior Publication Data

US 2011/0104368 A1 May 5, 2011

(30) Foreign Application Priority Data

Oct. 29, 2009 (JP) ..... 2009-248910

(51) Int. Cl.

| | |
|---|---|
| ***B28B 7/38*** | (2006.01) |
| ***B22C 3/00*** | (2006.01) |
| ***B05D 5/06*** | (2006.01) |
| ***C23C 26/00*** | (2006.01) |

(52) U.S. Cl.

CPC ..... *C23C 26/00* (2013.01)
USPC ..... 427/135; 427/133; 427/543; 427/544; 427/545

(58) Field of Classification Search

USPC ..... 106/38.2, 38.22, 38.23; 164/6, 9, 12, 164/14, 47, 72, 80; 249/114.1, 115; 427/133, 134, 543, 544, 545, 135

See application file for complete search history.

(56) References Cited

U.S. PATENT DOCUMENTS

| | | | | |
|---|---|---|---|---|
| 7,011,135 | B2 * | 3/2006 | Kato et al. | 164/97 |
| 2007/0119703 | A1 * | 5/2007 | Chen | 204/192.15 |
| 2008/0206444 | A1 * | 8/2008 | Matsuo et al. | 427/11 |

FOREIGN PATENT DOCUMENTS

| | | | |
|---|---|---|---|
| JP | 2007-100210 | A | 4/2007 |
| JP | 2007-144499 | A | 6/2007 |
| JP | 2008-105082 | A | 5/2008 |
| WO | 2008/139880 | A1 | 11/2008 |

OTHER PUBLICATIONS

M. Monthioux et al.: "Hybrid carbon nanotubes: Strategy, progress and perspectives", Journal of Materials Research, vol. 21, No. 11, Nov. 30, 2006, pp. 2774-2793.

Chinese Office Action for corresponding CN Patent Application No. 201010528585.6 issued on Jul. 13, 2012.

* cited by examiner

*Primary Examiner* — Michael Wieczorek
(74) *Attorney, Agent, or Firm* — Sughrue Mion, PLLC

(57) ABSTRACT

A method of treating a surface of a mold that includes supplying a fullerene into an amorphous carbon layer that covers the surface of the mold and heating the amorphous carbon layer to at least 400° C. while covering a surface of the amorphous carbon layer with a covering member.

9 Claims, 5 Drawing Sheets

METHOD OF TREATING SURFACE OF MOLD

INCORPORATION BY REFERENCE

The disclosure of Japanese Patent Application No. 2009-248910 filed on Oct. 29, 2010, including the specification, drawings and abstract is incorporated herein by reference in its entirety.

BACKGROUND OF THE INVENTION

1. Field of Invention

The present invention relates to a method of treating a surface of a mold. More specifically, the present invention is directed to a method of forming a carbon film that covers the surface of a mold.

2. Description of Related Art

A technique that uses a mold to produce products with the same shape and quality in a large quantity is known. Japanese Patent Application Publication No. 2008-105082 (JP-A-2008-105082) describes covering the surface of a mold with a carbon film so that the molded product may be easily released from the mold. JP-A-2008-105082 describes covering the surface of a mold with fibrous nanocarbons to improve abrasion resistance, corrosion resistance, thermal conductivity, friction properties and mechanical strength of the surface. Using this technique, on a casting mold, for example, a melt is less likely to stick to the casting mold so that the service life of the casting mold may be increased. In JP-A-2008-105082, carbon nanocoils, carbon nanotubes and carbon nanofilaments are cited as examples of the nanocarbons. They are classified into crystalline carbons.

According to the technique that is described in JP-A-2008-105082, separation of the carbon film from the mold surface may be prevented by the anchor effect of the fibrous nanocarbons. With such an anchor effect of the nanocarbon alone, however, the carbon film is liable to be separated from the mold surface when the production (casting) process using the mold is repeatedly carried out. JP-A-2008-105082 describes that the separation of the carbon film from the mold may be suppressed when a nitride layer or the like is provided between the carbon film and the mold surface. With such a method, however, cracking of nitride layer or separation of the carbon film from the nitride layer inevitably occurs when the production process is repeated. When the carbon film separates from the mold, it is necessary to conduct a maintenance operation to provide a carbon film again. Thus, a need exists for a technique by which separation between the carbon film and the mold can be prevented and the service life of the mold can be further improved.

SUMMARY OF THE INVENTION

The present invention provides a method of covering the surface of a mold with an amorphous carbon layer and depositing fullerenes in voids present in the amorphous carbon layer.

A fullerene is a carbon cluster that has a closed shell structure and usually has an even number of carbon atoms between 60 and 130. Specific examples include $C_{60}$, $C_{70}$, $C_{76}$, $C_{78}$, $C_{80}$, $C_{82}$, $C_{84}$, $C_{86}$, $C_{88}$, $C_{90}$, $C_{92}$, $C_{94}$ and $C_{96}$ carbon clusters and higher-order carbon clusters that have a larger number of carbon atoms. The term "fullerene" as used herein is intended to include, in addition to the above fullerenes, fullerene derivatives that are obtained by chemically modifying fullerene molecules by other molecules or functional groups.

An aspect of the present invention relates to a method of treating a surface of a mold. The mold surface treating method includes supplying a fullerene into an amorphous carbon layer that covers a surface of the mold, and heating the amorphous carbon layer to at least 400° C. while covering a surface of the amorphous carbon layer with a covering member.

According to the above surface treatment method, the voids in the amorphous carbon layer are filled with the fullerene. When heated to 400° C. or higher, the fullerene is sublimated from solid to gas and thereafter is converted into an amorphous state. That is, as a consequence of the above treatment method, the amorphous carbon layer is densified so that the bonding between the carbon film (amorphous carbon layer) and the mold is thereby enhanced and separation of the carbon film from the mold can be effectively prevented.

Because the covering member is in contact with the carbon film, the fullerene, which has been sublimated into gas, penetrates into the carbon film. That is, the fullerene, which has been sublimated into gas, is restrained from leaking out of the carbon film. For example, when the amorphous carbon layer is heated to 400° C. or higher without contacting the covering member with the surface of the carbon film, the fullerene, which has been sublimated into gas, can diffuse out of the carbon film. Thus, the carbon film cannot be sufficiently strengthened. On the other hand, when a fullerene is supplied into a crystalline carbon layer, the fullerene, when sublimated into gas, passes through the crystalline carbon layer and penetrates into the mold. Thus, even when the fullerene is supplied into the crystalline carbon layer, the effect of fullerene in strengthening the carbon film (crystalline carbon layer) decreases. In the method of treating a surface of a mold according to an aspect of the present invention, a strengthened carbon film can be obtained when both the following conditions are satisfied: "the carbon film that covers the mold is composed of an amorphous carbon," and "the carbon film is heated to 400° C. or higher in a state of being covered with a covering member."

BRIEF DESCRIPTION OF THE DRAWINGS

The foregoing and further features and advantages of the invention will become apparent from the following description of preferred embodiments with reference to the accompanying drawings, wherein like numerals are used to represent like elements and wherein.

DETAILED DESCRIPTION OF EMBODIMENTS

Technical features of an embodiment of the present invention are described below. The supply of a fullerene into the amorphous carbon layer that covers a surface of the mold can be achieved by applying a liquid that contains a fullerene to a surface of the amorphous carbon layer. By applying a liquid that contains a fullerene to a surface of the amorphous carbon layer, the fullerene can be uniformly supplied into the amorphous carbon layer. The liquid in which a fullerene is dispersed is preferably selected from alcohols. Because a fullerene can be easily dispersed in an alcohol, a liquid that contains a fullerene can be easily prepared. Also, after the application of the liquid to the amorphous carbon layer, the alcohol vaporizes so that only the fullerene remains in the amorphous carbon layer. Thus, there is no need to wipe off the alcohol.

The mold may be made of SKD61 (hot-die steel) that is specified in JIS. One example of the mold is a casting mold for use in the production of an aluminum product. A surface of the mold is covered with a carbon film. The carbon film is strengthened by a fullerene. Thus, the fluidity of the aluminum melt may be ensured and the aluminum melt is prevented from penetrating into the carbon film.

The surface of the mold may be directly covered with the carbon film (amorphous carbon layer). Alternatively, a nitride layer and/or a sulfurized layer may be provided between the mold and the carbon film.

Examples of the present invention are described below. First, a method of applying a fullerene to a carbon film (amorphous carbon layer) is described. The method of covering a mold surface with a carbon film and the method of providing a carbon film on a mold surface with a nitride layer and/or a sulfurized layer interposed therebetween are well-known. Their description is therefore omitted here.

Figure 1:
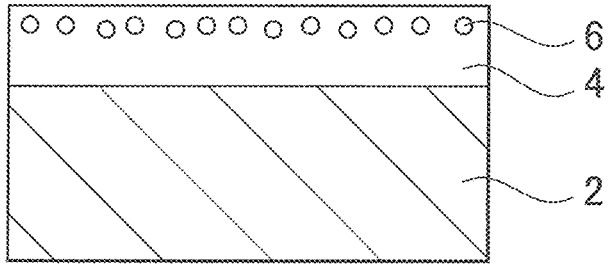
FIG. 1 is a schematic view of a carbon film into which a fullerene has been supplied.

As shown in FIG. 1, isopropyl alcohol that contained 1% by weight of fullerene $C_{60}$ (NANOM PURPLE ST, manufactured by Frontier Carbon Corporation) was applied with a brush to a surface of a mold 2 on which an amorphous carbon layer 4 had been formed. Then isopropyl alcohol was allowed to vaporize at ambient temperature so that only fullerene $C_{60}$ powder 6 remained in the amorphous carbon layer 4. In the following description, the fullerene $C_{60}$ powder 6 will be occasionally referred to as "fullerene 6," and the amorphous carbon layer 4 will be occasionally referred to as "carbon film 4." At this stage, the carbon film 4 and the fullerene 6 are bound by the van der Waals force. After that, the mold 2 was heated to 300° C. At this stage, the carbon film 4 and the fullerene 6 are covalently bonded to each other. The fullerene 6 was present only in a limited area near the surface of the carbon film 4 and did not penetrate deep into the carbon film 4.

Figure 2:
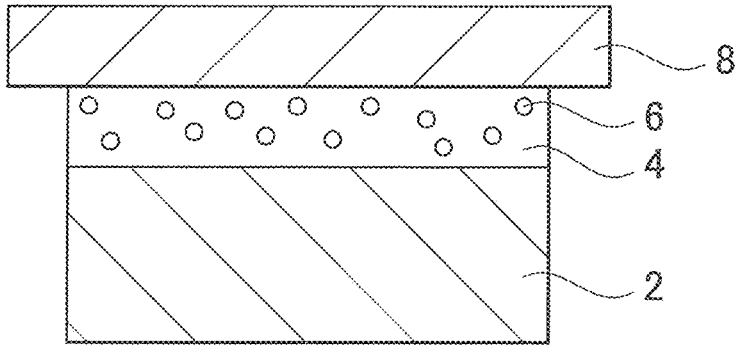
FIG. 2 is a schematic view that illustrates a phenomenon in which a fullerene penetrates into a carbon film (1)

Next, as shown in FIG. 2, a metal plate 8 was brought into contact with the surface of the carbon film 4. The metal plate 8 was then heated to between 400 to 700° C. The metal plate 8 is one example of a covering member. When the metal plate 8 was heated, the temperature of the carbon film 4 increased. When the temperature of the carbon film 4 (fullerene 6) exceeded 400° C., the powdery fullerene 6 was sublimated into gas and penetrated into the carbon film 4. After that, the mold 2 was cooled to approximately 300° C. with the metal plate 8 remaining in contact with the surface of the carbon film 4. Then, the gaseous fullerene 6 was deposited into solid in the carbon film 4. This prevented the fullerene 6, which had been sublimated into gas, from diffusing out of the carbon film 4. After that, the metal plate 8 was removed and the mold 2 was cooled. In the following description, a phase change from the solid to gaseous state is referred to as "sublimation," and a phase change from the gaseous to solid state is referred to as "deposition." The sublimated fullerene 6 flowed into voids in the carbon film 4. In other words, the vulnerable sites of the carbon film 4 were filled with the fullerene 6. When the fullerene 6 was deposited, the amorphous carbon layer (carbon film 4) and the fullerene that had been converted into an amorphous state were bonded to each other by metallic bonds. Because the carbon film 4 was densified and strengthened, the carbon film 4 was able to be effectively prevented from separating from the mold 2. Because the carbon film 4 and the fullerene 6 were firmly bounded to each other by metallic bonds, the fullerene 6 was prevented from leaking out of the carbon film 4 or from penetrating into the mold 2 even when a high-temperature material was brought into contact with the surface of the carbon film 4, for example. The upper limit of the temperature to which the metal plate 8 is heated can be set within a temperature range in which the mold 2 is not deformed beyond a prescribed degree. In this Example, the metal plate 8 is preferably heated to 700° C. or lower to prevent deformation of the mold 2 because the melting point of the mold 2 is approximately 1400° C.

As described above, when the carbon film 4 into which the fullerene 6 has been supplied is heated to 400° C. or higher, the carbon film 4 is strengthened. Therefore, even when heat is subsequently applied to the carbon film 4, the fullerene 6 is prevented from leaking out of the carbon film 4 or penetrating into the mold 2. The strength of the carbon film 4 may be maintained for a long period of time. In other words, even when heat is applied to the densified carbon film 4, the structure of the carbon film 4 is unlikely to change. The mold 2 that has the carbon film 4 as described above may be used as a casting mold for use in the production of an aluminum product. Because the carbon film 4 is densified, aluminum melt is prevented from penetrating into the mold. Also, because the carbon film 4 is prevented from separating from the surface of the mold 2, the mold release resistance and sticking of the aluminum product may be maintained at a low level for a long period of time. When a layer that prevents carbon infiltration is provided between the mold 2 and the carbon film 4, infiltration of the sublimated fullerene 6 into the mold 2 may be prevented more reliably. Specific examples of the layer that prevents carbon infiltration include a nitride layer and a sulfurized layer.

Figure 3:
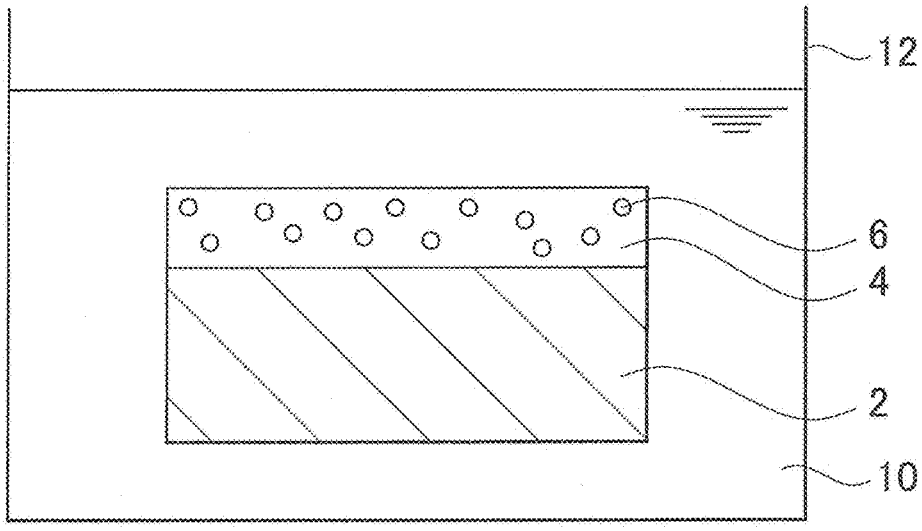
FIG. 3 is a schematic view that illustrates another phenomenon in which a fullerene penetrates into a carbon film (2)

FIG. 3 illustrates another method of transferring the fullerene 6 into the carbon film 4. A container 12 contains a metal melt 10. The metal melt 10 has a temperature of 400° C. or higher. As the metal melt 10, an aluminum alloy that has a melting point of 580° C. (which corresponds to ADC12 that is specified in JIS), tin, which has a melting point of 231.9° C., and so on, for example, may be used. First, after the fullerene 6 has been supplied into the carbon film 4 (see FIG. 1), the mold 2 is immersed into the metal melt 10. The carbon film 4 is instantaneously sealed and heated by the metal melt 10. In this case, the metal melt 10 fulfills the function of a covering member. Because the fullerene 6 is sublimated with the carbon film 4 being sealed, the fullerene 6 penetrates deep into the carbon film 4. After that, the mold 2 is cooled to a temperature below 400° C. and taken out of the metal melt 10. The metal melt 10 that is attached to the mold 2 is then removed. Thereafter, the mold 2 is cooled at room temperature. The sublimated fullerene 6 is thereby deposited in the carbon film 4. When tin was used as the metal melt 10, for example, and when the mold 2 was immersed into the tin 10 at 450° C., the carbon film 4 was heated to 400° C. or higher with the surfaces of the mold 2 having been sealed. The fullerene 6 was sublimated and allowed to penetrate into the carbon film 4. When the mold 2 was subsequently cooled to 300° C., the fullerene 6 was deposited in the carbon film 4. The sublimated fullerene 6 did not diffuse out of the carbon film 4. Because the melting point of tin is 231.9° C. as described above, the metal melt 10 was not solidified even after the fullerene 6 had been deposited in the carbon film 4. Therefore, the mold 2 was able to be easily taken out of the metal melt 10. This method is particularly effective when the surfaces of a mold is almost entirely covered with a carbon film. For example, when surfaces of a core insert are covered with a carbon film, for example, the entire carbon film on the surfaces of the core insert may be strengthened by one procedure. The metal melt 10 may have a freezing point of 400° C. or higher. In this case, the solidified metal melt 10 may be removed from the mold 2 after the mold 2 has been cooled to a temperature below 400° C.

The work of taking the mold 2 out of the metal melt 10 and the work of removing the solidified metal melt 10 from the mold 2 are preferably carried out in an inert atmosphere such as nitrogen ($N_2$) or argon (Ar). Oxidation of the carbon film 4 and the fullerene 6 may be prevented.

Figure 4:
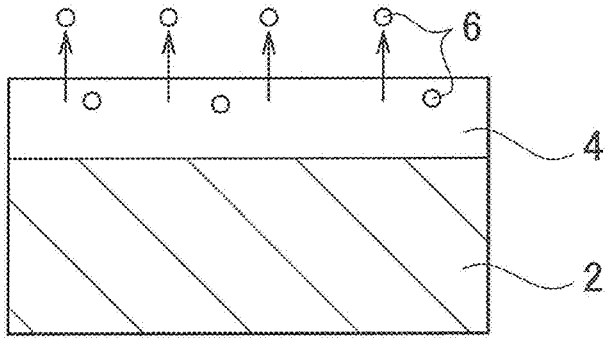
FIG. 4 is a schematic view that illustrates a phenomenon in which a fullerene diffuses out of a carbon film.

Next, a first comparative example is described in which the carbon film 4 was heated to 400° C. or higher without contacting a covering member with the surface of the carbon film 4. As described above, the fullerenes is sublimated when heated to 400° C. or higher. When the surface of the carbon film 4 was open as shown in FIG. 4, the sublimated fullerene 6 leaked out of the carbon film 4. Thus, the carbon film 4 was hardly densified and the problem of separation of the carbon film 4 from the mold 2 was not solved. The covering member has a function of keeping the sublimated fullerene 6 within the carbon film 4. Also, the covering member in the above-described embodiment also has a function of transferring heat to the fullerene 6 that has been supplied into the carbon film 4.

Figure 5:
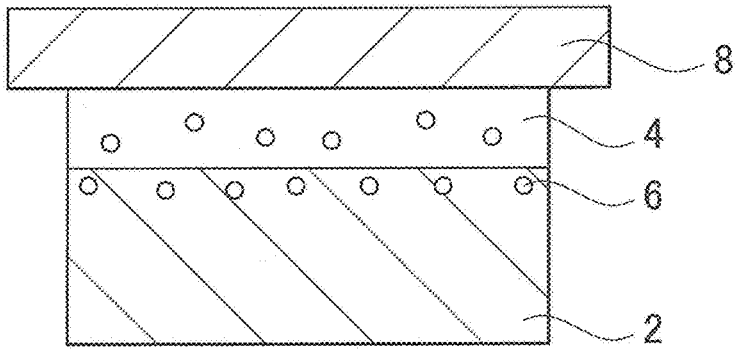
FIG. 5 is a schematic view that illustrates a phenomenon in which a fullerene passes through a carbon film and penetrates into a mold.

A second comparative example in which a crystalline carbon is used as a material of the carbon film 4 is next described. The reference number 4*a* in FIG. 5 indicates a crystalline carbon layer. When the metal plate 8 was contacted with a surface of the crystalline carbon layer 4*a* as shown in FIG. 5, the sublimated fullerene 6 was able to be prevented from leaking out of the crystalline carbon layer 4*a* to the exterior (atmosphere). However, the sublimated fullerene 6 penetrated into the mold 2 through voids in the crystalline carbon layer 4*a*. Thus, the fullerene 6 brought about infiltration of carbon into the mold 2. Therefore, the effect of the fullerene in densifying the carbon film 4*a* decreased and the problem of separation of the carbon film 4*a* from the mold 2 was not solved.

The carbon film may be strengthened when both the following conditions are satisfied as described above: an amorphous carbon layer is provided on a surface of the mold 2, and the amorphous carbon layer into which a fullerene has been supplied is heated to 400° C. or higher in a state of being covered with a covering member.

Figure 6:
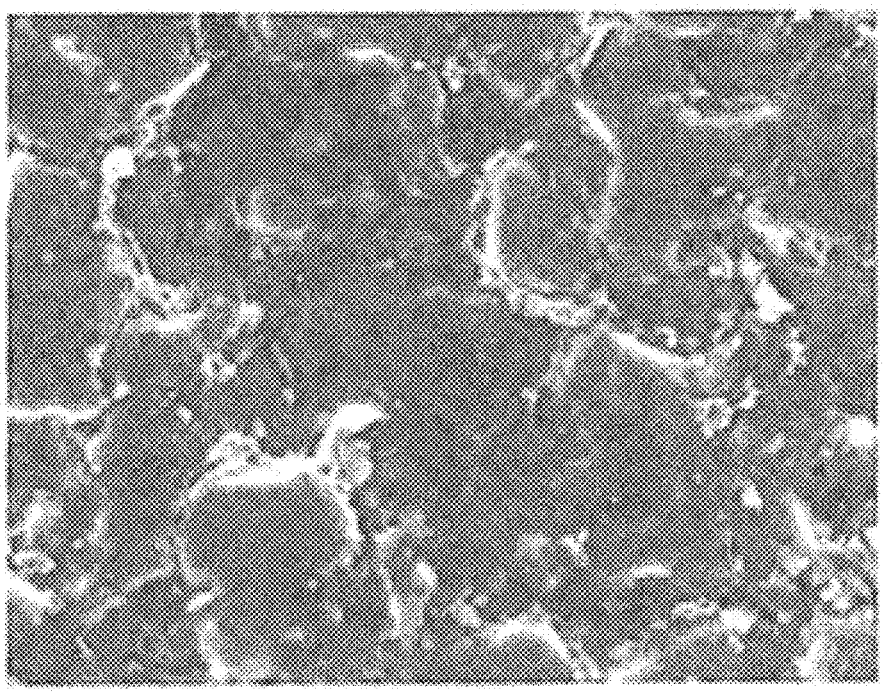
FIG. 6 is an SEM image of a surface of a carbon film obtained in Example.
Figure 7:
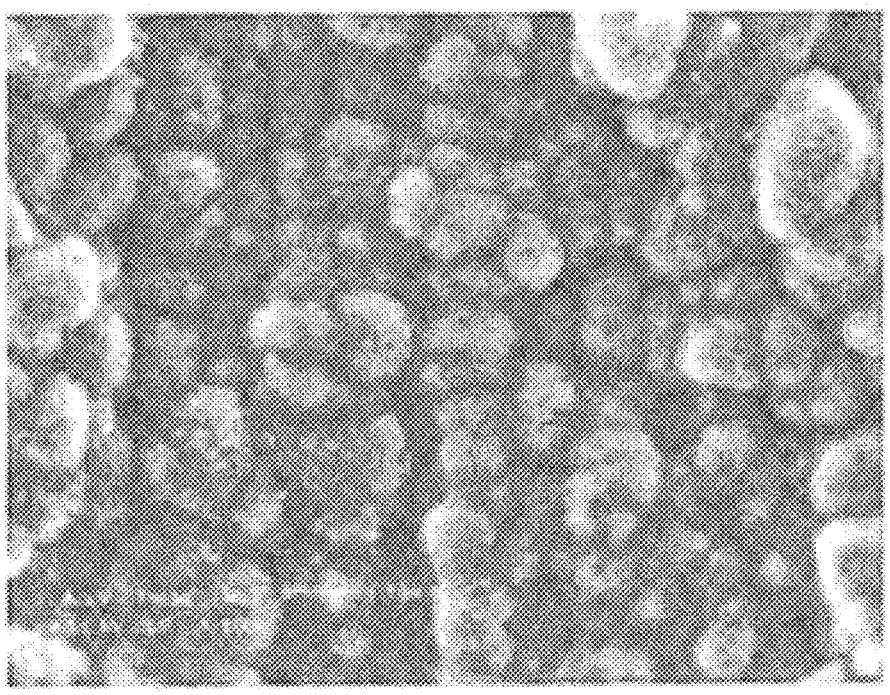
FIG. 7 is an SEM image of a surface of a carbon film of a first comparative example (1)
Figure 8:
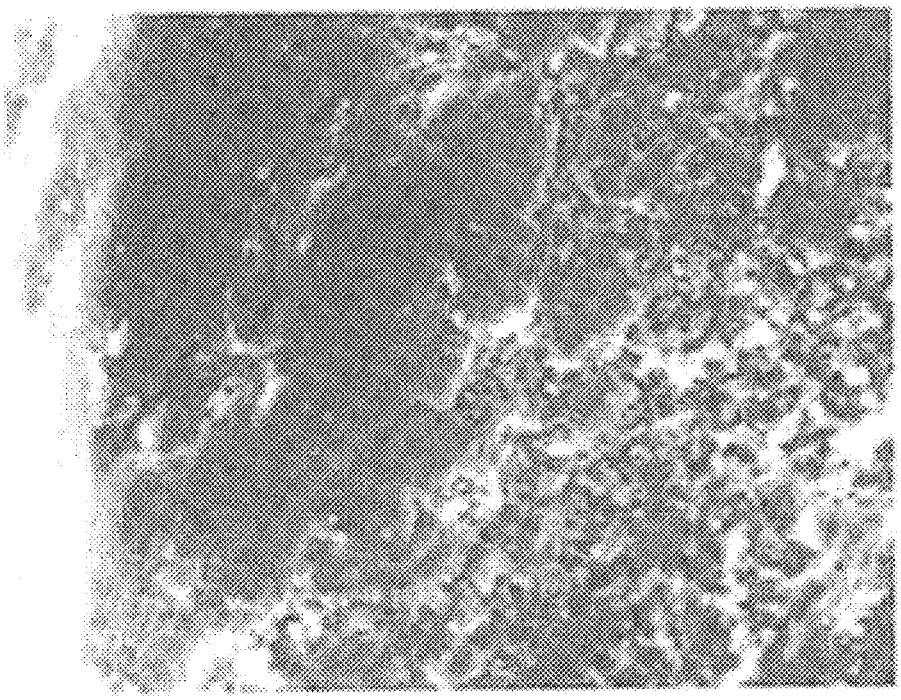
FIG. 8 is an SEM image of a surface of a carbon film of a second comparative example (2).

FIG. 6 is an SEM image of a carbon film 4 that has been treated by the method of the above Example. FIG. 7 is an SEM image of a carbon film 4 (amorphous carbon layer) as formed on the second mold. FIG. 8 is an SEM image of a carbon film 4 into which the fullerene 6 has been supplied (but before carbon film 4 is heated). As shown in FIG. 8, when the fullerene 6 is supplied into the amorphous carbon layer 4, only the fullerene 6 is observed and the amorphous carbon layer 4 is not observed (also see FIG. 7). This indicates that the fullerene 6 has not penetrated into the amorphous carbon layer 4 and stays mainly in the superficial layer of the amorphous carbon layer 4. On the contrary, when the carbon film 4 is treated by the method of the above embodiment, it is observed that the voids in the amorphous carbon layer 4 are filled with the fullerene 6 (see FIG. 6). That is, it is observed that the carbon film 4 is densified. FIG. 6 is an SEM image of the carbon film 4 that has been used to produce an aluminum product 6000 times. It has been observed that the amorphous carbon remains for a long period of time in the carbon film that have been treated by the method of the above embodiment. Although not shown, when a crystalline carbon layer into which a fullerene had been supplied was heated in a sealed state, a carbon-infiltrated layer was observed on the mold surface.

The results of the above of examples and comparative examples are summarized below. By covering a surface of a mold with an amorphous carbon layer, infiltration of fullerene into the mold is prevented. By heating the mold while covering the amorphous carbon layer with a covering member, sublimated fullerene is prevented from leaking out of the amorphous carbon and the fullerene effectively penetrates into the amorphous carbon layer. As a result, the carbon film (amorphous carbon layer) is densified and becomes less likely to separate from the mold. Crystalline carbons are usually in a fibrous form. Fibrous materials could be harmful to humans. The use of an amorphous carbon is preferred from a safety point of view as well. Also, even when the carbon film separates from the mold, an amorphous carbon causes less damage to the product than a fibrous crystalline carbon.

An example in which a brush is used to apply the liquid that contains a fullerene to the carbon film is described in the above embodiment. However, a powdery fullerene may be directly applied to the carbon film, for example. Alternatively, the liquid that contains a fullerene may be supplied to the carbon film using a spray or the like.

While the invention has been described with reference to example embodiments thereof, it is to be understood that the invention is not limited to the described embodiments or constructions. The invention is intended to cover various modifications and equivalent arrangements. In addition, while the various elements of the invention are shown in various example combinations and configurations, other combinations and configurations, including more, less or only a single element, are also within the scope of the appended claims.

What is claimed is:

1. A method of treating a surface of a mold prior to molding operations, comprising:

supplying a fullerene into an amorphous carbon layer that covers the surface of the mold; and covering a surface of the amorphous carbon layer with a covering member while heating the amorphous carbon layer to at least 400° C. the covering member being in direct contact with the surface of the amorphous carbon layer during heating, so as to cause the fullerene to convert into an amorphous state and the amorphous carbon layer to densify.

2. The method according to claim 1, wherein the covering member is a metal with a melting point that is lower than the melting point of the mold, and the amorphous carbon layer is heated to at least 400° C. by immersing the amorphous carbon layer, into which the fullerene has been supplied, into the metal which is in a molten state.

3. The method according to claim 2, wherein, after the amorphous carbon layer has been immersed in the metal and heated to at least 400° C., the amorphous carbon layer is separated from the metal in an inert atmosphere.

4. The method according to claim 2, wherein the metal is ADC12 specified in JIS or tin.

5. The method according to claim 1, wherein, after the amorphous carbon layer is covered with the covering member and heated to at least 400° C., the amorphous carbon layer, still in the state of being covered with the covering member, is cooled to below 400° C.

6. The method according to claim 1, wherein the upper limit of the heating temperature is set in a range in which the mold is not deformed beyond a prescribed degree.

7. The method according to claim 6, wherein the upper limit of the heating temperature is 700° C.

8. The method according to claim 1, wherein a layer that prevents carbon infiltration is provided between the mold and the amorphous carbon layer.

9. The method according to claim 8, wherein the layer that prevents carbon infiltration is a nitride layer or a sulfurized layer.

* * * * *